US009681215B2

(12) United States Patent
Liu et al.

(10) Patent No.: US 9,681,215 B2
(45) Date of Patent: Jun. 13, 2017

(54) SPEAKER MODULE

(71) Applicant: GOERTEK INC., Shandong (CN)

(72) Inventors: Yitao Liu, Weifang (CN); Zhigan Dai, Weifang (CN); Qing Miao, Weifang (CN)

(73) Assignee: GOERTEK INC., Weifang, Shandong Province (CN)

( * ) Notice: Subject to any disclaimer, the term of this patent is extended or adjusted under 35 U.S.C. 154(b) by 0 days.

(21) Appl. No.: 14/781,101

(22) PCT Filed: Apr. 15, 2014

(86) PCT No.: PCT/CN2014/075376

§ 371 (c)(1),
(2) Date: Sep. 29, 2015

(87) PCT Pub. No.: WO2014/169805

PCT Pub. Date: Oct. 23, 2014

(65) Prior Publication Data

US 2016/0261949 A1 Sep. 8, 2016

(30) Foreign Application Priority Data

Apr. 16, 2013 (CN) ..... 2013 1 0132097

(51) Int. Cl.

| | |
|---|---|
| ***H04R 9/08*** | (2006.01) |
| ***H04R 1/28*** | (2006.01) |
| *H04R 1/02* | (2006.01) |

(52) U.S. Cl.

CPC ..... *H04R 1/2826* (2013.01); *H04R 1/288* (2013.01); *H04R 1/2842* (2013.01);
(Continued)

(58) Field of Classification Search

CPC .... H04R 1/2826; H04R 1/2842; H04R 1/288; H04R 1/2896

(Continued)

(56) References Cited

U.S. PATENT DOCUMENTS 3,938,617 A * 2/1976 Forbes ..... H04R 1/345 181/148

4,872,527 A 10/1989 Han (Continued)

FOREIGN PATENT DOCUMENTS

CN 202218378 5/2012
CN 202218379 U 5/2012

(Continued)

OTHER PUBLICATIONS

State Intellectual Property Office of the People's Republic of China, Office Action, Apr. 24, 2015.

*Primary Examiner* — Md S Elahee
*Assistant Examiner* — Julie X Dang
(74) *Attorney, Agent, or Firm* — Themis Law

(57) ABSTRACT

A speaker module includes a casing and a speaker unit housed and fixed in the casing, a rear acoustic cavity being formed between the casing and the speaker unit, wherein at least one baffle wall is provided on the casing in the rear acoustic cavity and divides the rear acoustic cavity into at least two cavities, and wherein at least one slit is formed between the baffle walls or on the baffle wall, so that sound generated by the speaker unit can spread to an adjacent cavity inside the rear acoustic cavity through the slit.

10 Claims, 2 Drawing Sheets

(52) U.S. Cl.
CPC ..... *H04R 1/2888* (2013.01); *H04R 1/2896* (2013.01); *H04R 1/021* (2013.01)

(58) Field of Classification Search
USPC ..... 381/308, 353, 337, 349; 181/155, 156, 181/219, 264, 270, 277
See application file for complete search history.

(56) References Cited

U.S. PATENT DOCUMENTS

| | | | | |
|---|---|---|---|---|
| 2007/0128434 | A1* | 6/2007 | Motoda | D06M 11/45 428/375 |
| 2009/0193774 | A1* | 8/2009 | Zanni | B01D 53/0446 55/484 |
| 2010/0061571 | A1* | 3/2010 | Choi | H04R 1/288 381/160 |
| 2012/0085291 | A1* | 4/2012 | Conger | A01K 1/0047 119/419 |

FOREIGN PATENT DOCUMENTS

| | | | | |
|---|---|---|---|---|
| CN | 102630068 | | 8/2012 | |
| CN | 202799032 | U | 3/2013 | |
| CN | 103220608 | | 7/2013 | |
| CN | 203225866 | | 10/2013 | |
| CN | WO 2014026318 | A1 * | 2/2014 | H04M 1/035 |
| FR | 2414275 | | 8/1979 | |
| JP | H06-54392 | | 2/1994 | |
| JP | WO 2012157191 | A1 * | 11/2012 | H04N 5/642 |
| KR | 1020070070887 | | 7/2007 | |

* cited by examiner

SPEAKER MODULE

TECHNICAL FIELD

The present invention relates to the field of electro-acoustic technology, and more particularly, to a speaker module.

BACKGROUND ART

In related art, a speaker module includes a casing and speaker unit accommodated and fixed inside the casing, wherein a rear acoustic cavity is formed between the speaker unit and the casing, and the speaker unit includes a diaphragm which vibrates to generate sounds. Generally, the space at the front side of the vibrating diaphragm is in communication with the sounding hole of the speaker module to radiate sounds to outside, and the space at the rear side of the diaphragm is communicated with the rear acoustic cavity. Since there is a phase difference of 180° between the sounds generated at the front and back sides of the vibrating diaphragm, the spaces at the front and back sides of the vibrating diaphragm are disposed separately with an interval, in which the rear acoustic cavity is a sealed structure.

When the rear acoustic cavity is relatively large in volume, the speaker module has a good performance in low frequency, however, when the rear acoustic cavity is relatively large but the sounding hole in the speaker unit is relatively small, a significant effect of Helmholtz resonance is generated which has a negative influence on the sounding performance of the product. Therefore, it is necessary to improve the speaker module in the prior art to overcome the above defect.

SUMMARY OF THE INVENTION

In order to address the above technical problem, the present invention provides a speaker module which can reduce the impact of the Helmholtz resonance in the rear acoustic cavity to improve the acoustic performance of the product.

In order to achieve the above object, the present invention provides a speaker module including a casing and speaker unit housed and fixed in the casing, a rear acoustic cavity is formed between the casing and the speaker unit, wherein the casing in the rear acoustic cavity is provided with baffle walls which divides the rear acoustic cavity into at least two cavities, a slit is formed between the baffle walls or on the baffle walls, and the sound generated by the speaker unit can be communicated with an adjacent cavity inside the rear acoustic cavity through the slit.

Further, preferably, the casing is formed therein with at least two first baffle walls arranged side by side, and the slit is formed between two first baffle walls, a gap is formed between each of the two first baffle walls and a side wall of the casing, and the gaps formed by the two first baffle walls are positioned at the opposite sides.

Further, preferably, the casing includes a second baffle wall, which is provided with a slit thereon for communication with the cavities at the two sides of the second baffle wall.

Further, preferably, the casing comprises a first casing and a second casing independent from each other, the second casing fixes the speaker unit, and the rear acoustic cavity is located on a lateral side of the speaker unit; and the second casing has a long-narrow shape, and the second casing is provided with the first baffle walls and/or the second baffle walls thereon.

Further, preferably, the width and position of the slit is adjustable.

Further, preferably, the first baffle wall and the slit formed by the first baffle wall is provided in two sets; the number of the second baffle walls is two, and the number of the slits provided on the second baffle wall is at least two.

Further, preferably, the first baffle wall and the second baffle wall have the same height as that of the side wall of the second casing, and a connection gasket is provided between the first and second baffle walls and a side wall of the first casing, and the thickness of the connection gasket is equal to the height of the side wall of the first casing.

Further, preferably, the connection gasket is formed of gas-adsorbing material.

Further, preferably, the gas-adsorbing material is a carbon fiber non-woven fabric.

Compared with the conventional configuration, the rear acoustic cavity of the speaker module of the present invention is provided with baffle walls which divide the rear acoustic cavity into a plurality of cavities, and slits for communicating between adjacent two cavities are provided between the baffle walls or on the baffle walls, which can increase the acoustic resistance of the rear acoustic cavity, thereby reducing the impact of Helmholtz resonance and improve the acoustic performance of the product.

BRIEF DESCRIPTION OF THE DRAWINGS

The above features and advantages of the present invention will become obvious and easily understood upon reading the following description with reference to the drawings.

DETAILED DESCRIPTION OF THE EMBODIMENTS

The present invention will be described in further detail with reference to the drawings and the embodiments.

Figure 1:
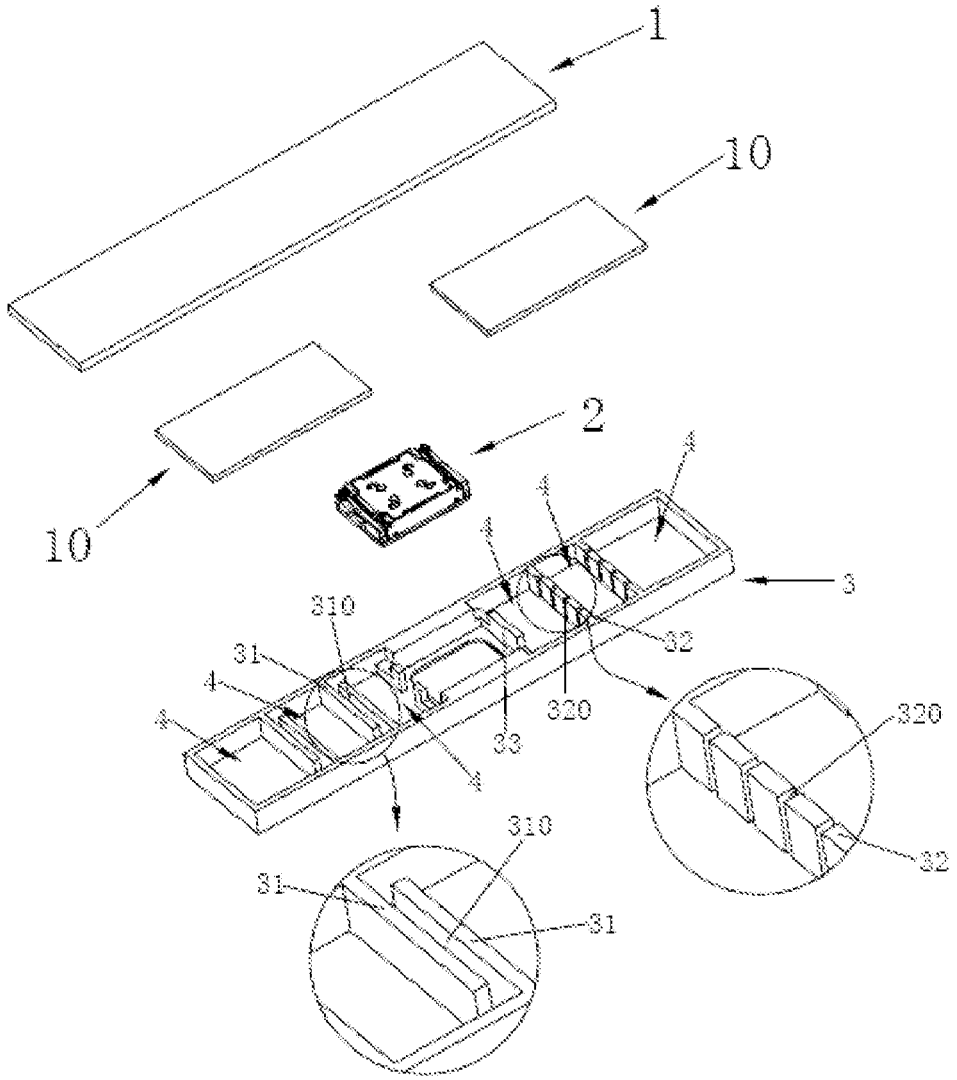
FIG. 1 illustrates the exploded perspective view of the speaker module of the present invention.
Figure 2:
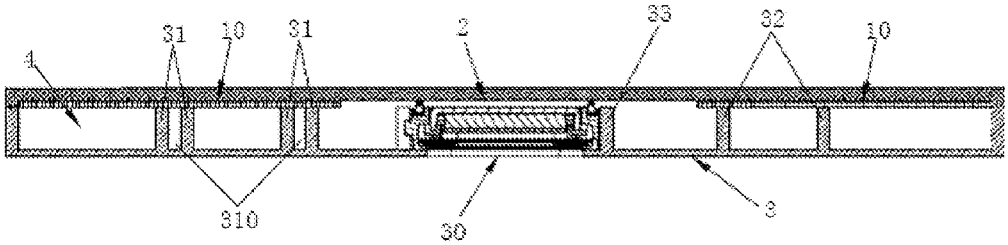
FIG. 2 illustrates a sectional view of the speaker module of the present invention.

As shown in FIG. 1 and FIG. 2, a speaker module comprises a casing and a speaker unit 2 housed in the casing, the casing includes a first casing 1 and a second casing 3 for convenience of assembling of the speaker module. In the speaker module of present embodiment, the second casing 3 fixes the speaker unit 2, and a rear acoustic cavity 4 is formed between the speaker unit 2 and the second casing 3, wherein the rear acoustic cavity 4 is a sealed structure. In the present embodiment, the speaker module radiate sounds to outside from the front side thereof, and sounding hole 30 are provided on one side of the second casing 3 directly facing the diaphragm of the speaker unit 2, as shown in FIG. 2, and the rear acoustic cavity 4 is located away from the sounding hole 30. In the present embodiment, the rear acoustic cavity 4 is divided into a plurality of cavities by a plurality of baffle walls, wherein adjacent cavities are in communication with each other through a slit.

The second casing 3 is provided thereon with adjacent first baffle walls 31 arranged side by side, and a narrow space between the two first baffle walls 31 forms a slit 310. A gap is formed between each of the two baffle walls 310 and a side wall of the second casing 3. The gaps formed by the two baffle walls 31 and the second casing 3 are at the opposite sides of the second casing 3. The cavities at two sides of the two first baffle walls 31 are in communication with each other through the slit 310. Specially, the sound generated by the speaker unit 2 first spreads through the gap near to the speaker unit 2, then through the slit 310, and then through the gap away from the speaker unit 2 and finally reaches another cavities of the rear acoustic cavity 4, which is relatively farther from the speaker unit 2. Such configuration of the first baffle walls 31 in the rear acoustic cavity 4 divides the rear acoustic cavity 4 into a plurality of cavities which are in communication with each other through the slits between the first baffle walls to increase the acoustic resistance of the rear acoustic cavity 4, thereby reducing the impact of Helmholtz resonance caused by the overly large volume of the rear acoustic cavity 4 or overly small size of the sounding hole of the speaker unit 2 thus improving the acoustic performance of the product. In addition, in the present embodiment, the second casing 3 has a slim shape and the speaker unit 2 is located in the middle portion of the second casing 3, and in order to be fit with the slim rear acoustic cavity 4 formed by the slim second casing 3 and the speaker unit 2, the speaker module of the present embodiment may comprise two sets of first baffle walls 31 and slit 310, and more than one set of such structure may divide the slim rear acoustic cavity 4 into more cavities thereby further reducing the impact of Helmholtz resonance and improving the acoustic performance of the product.

Further, the slit is not limited to the above mentioned slit formed between adjacent baffle walls, and may be embodied in other forms such as slit formed on the baffle wall. As shown in FIG. 1 and FIG. 2, the rear acoustic cavity 4 of the speaker module may be further provided with second baffle walls 32 which separates the rear acoustic cavity into a plurality of cavities, and the two ends of the second baffle wall 32 may be connected with the side walls of the second casing 3, and the second baffle wall 32 is provided with a slit 320 for communication between the cavities at the two sides of the second baffle wall 32. The slit 320 may also increase the acoustic resistance of the rear acoustic cavity 4, reduce the generation of standing wave and improve the acoustic performance of the product. Further, two second baffle wall 32 may be provided to further adjust the sounding of the slim rear acoustic cavity 4, thereby improving the acoustic performance of the product.

It should be noted that the rear acoustic cavity 4 is a sealed structure, and adjacent cavities can be in communication with each other only through the slits. Therefore, the first baffle walls 31 and the second baffle walls 32 may contact with inner side surface of the first casing 1 facing the speaker unit 2. The first and second baffle walls 31 and 32 separate the rear acoustic cavity 4 into cavities in such a way that adjacent cavities can be in communication only through the slits. Alternatively, baffle walls may be provided on the inner side of the first casing 1 at the positions corresponding to the first baffle walls 31 and the second baffle walls 32, and the baffle walls provided on the inner side of the first casing 1 may be mated with the first and second baffle walls 31 and 32 to form separate cavities. In the present embodiment, the first and second baffle walls 31 and 32 have the same height with that of the side wall of the second casing 3, thus it is easy to form with a simple process. The first casing 1 and the second casing 3 may be combined and fixed with each other through ultrasonic welding. Since the side walls of the first casing 1 has a certain height, there is a certain distance between the first and second baffle walls 31 and 32 and the inner side surface of the first casing 1 facing the speaker unit 2. In order to allow the separate cavities to be in communication with each other only through the slits, a connection gasket 10 is provided between the inner side surface of the first casing 1 and the first and second baffle walls 31 and 32. Preferably, the thickness of the connection gasket 10 is equal to the height of the side walls of the first casing 1, as shown in FIG. 1 and FIG. 2, wherein the connection gasket 10 may be foam or gas adsorbing material such as a carbon fiber non-woven fabric. The gas adsorbing material may further expand the equivalent volume of the rear acoustic cavity 4 to further improve the low frequency acoustic performance of the product.

Further, the width, position and number of the slit are adjustable and may be adjusted according to the specific shape of the rear acoustic cavity of the speaker module.

Based on the above description, those skilled in the art may make other improvements and variations to the above embodiments, all of which fall within the protection scope of the present invention. It should be understood for those skilled that the above detailed description is only intended to illustrate the present invention and the protection scope of the present invention is defined by claims and their equivalents.

What is claimed is:

1. A speaker module including:

a casing; and a speaker unit housed and fixed in the casing, a rear acoustic cavity being formed between the casing and the speaker unit, wherein at least one baffle wall is provided on the casing in the rear acoustic cavity and the at least one baffle wall divides the rear acoustic cavity into at least two cavities, and wherein at least one slit is formed between a pair of first baffle walls disposed next to each other, and/or within an interior portion of a second baffle wall, so that sound generated by the speaker unit travels through the slit and spreads to an adjacent cavity that is defined inside the rear acoustic cavity and that is wider than the slit.

2. The speaker module of claim 1, wherein a gap is formed between each pair of first baffle walls and a side wall of the casing, and the gaps formed by pairs of the first baffle walls together with the casing are positioned at the opposite sides of the casing.

3. The speaker module of claim 2, wherein the casing includes a first casing and a second casing independent from each other, the second casing fixes the speaker unit, and the rear acoustic cavity is located at a lateral side of the speaker unit, and wherein the second casing has an elongated shape which is provided with the first baffle walls and the second baffle wall thereon.

4. The speaker module of claim 3, wherein width and position of the slit are adjustable.

5. The speaker module of claim 3, wherein the first baffle walls and the slit formed by the first baffle walls are provided in two sets, the number of the second baffle walls being two, and the number of the slits provided on the second baffle wall being at least two.

6. The speaker module of claim 5, wherein the first and second baffle walls have a same height as the height of the side walls of the second casing, a connection gasket is provided between the first and second baffle walls and an inner side surface of the first casing facing the speaker unit, and a thickness of the connection gasket is equal to the height of a side wall of the first casing.

7. The speaker module of claim 6, wherein the connection gasket is formed of a gas adsorbing material.

8. The speaker module of claim 7, wherein the gas adsorbing material is a carbon fiber non-woven fabric.

9. The speaker module of claim 1, wherein the second baffle wall is provided with a plurality of slits thereon for communication between cavities at two sides of the second baffle wall.

10. The speaker module of claim 9, wherein the casing includes a first casing and a second casing independent from each other, the second casing fixing the speaker unit, and the rear acoustic cavity being located at a lateral side of the speaker unit, and wherein the second casing has an elongated shape which is provided with the first baffle walls and the second baffle walls thereon.

* * * * *